US007654064B2

(12) United States Patent
Riccardi et al.

(10) Patent No.: US 7,654,064 B2
(45) Date of Patent: Feb. 2, 2010

(54) PACKAGING MACHINE

(75) Inventors: Michael Riccardi, Wickliffe, OH (US); Bernard Lerner, Aurora, OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 0 days.

(21) Appl. No.: 12/209,338

(22) Filed: Sep. 12, 2008

(65) Prior Publication Data

US 2009/0064637 A1 Mar. 12, 2009

Related U.S. Application Data

(60) Provisional application No. 60/971,761, filed on Sep. 12, 2007.

(51) Int. Cl.
*B65B 5/00* (2006.01)

(52) U.S. Cl. ..... 53/469; 53/468; 53/476; 53/284.7

(58) Field of Classification Search ..... 53/469, 53/468, 473, 459, 476, 266.1, 284.7
See application file for complete search history.

(56) References Cited

U.S. PATENT DOCUMENTS

| | | | | |
|---|---|---|---|---|
| 3,254,468 | A | 6/1966 | Lerner | |
| 3,254,828 | A | 6/1966 | Lerner | |
| 3,359,703 | A * | 12/1967 | Quaadgras | 53/493 |
| 3,897,676 | A * | 8/1975 | Membrino | 53/572 |
| 4,674,268 | A * | 6/1987 | Gavronsky et al. | 53/468 |
| 4,899,520 | A | 2/1990 | Lerner | |
| 4,928,455 | A | 5/1990 | Gereby et al. | |
| 5,094,061 | A * | 3/1992 | Evers | 53/567 |
| 5,341,625 | A | 8/1994 | Kramer | |
| 5,371,521 | A | 12/1994 | Wehrmann | |
| 5,394,676 | A | 3/1995 | Lerner et al. | |
| 5,442,898 | A * | 8/1995 | Gabree et al. | 53/459 |
| 5,709,069 | A * | 1/1998 | Cronauer | 53/459 |
| 5,957,824 | A | 9/1999 | Lerner et al. | |
| 6,094,895 | A * | 8/2000 | Ravizza | 53/567 |
| 6,543,201 | B2 | 4/2003 | Cronauer et al. | |
| 6,742,317 | B2 | 6/2004 | Cronauer et al. | |
| 6,948,296 | B1 * | 9/2005 | Lerner et al. | 53/476 |
| 2004/0084106 | A1 * | 5/2004 | James | 141/313 |
| 2006/0005553 | A1 * | 1/2006 | Metzger | 62/135 |
| 2006/0162291 | A1 | 7/2006 | Gates et al. | |

FOREIGN PATENT DOCUMENTS

| | | |
|---|---|---|
| WO | 00/71423 | 11/2000 |

OTHER PUBLICATIONS

International Search Report and Written Opinion form PCT/US08/76110 dated Jan. 12, 2009.

* cited by examiner

*Primary Examiner*—Thanh K Truong
(74) *Attorney, Agent, or Firm*—Calfee, Halter & Griswold LLP

(57) ABSTRACT

Methods for forming packages from a web of preformed bags. In one exemplary method of forming packages from a web of preformed bags, a first bag is held open with air. A product is loaded into the first bag that is held open with air. An opening of the first bag is sealed. A next bag is indexed such that an opening of the next bag is proximate to an engagement member. The web is engaged with the engagement member. The web may be reverse indexed to pre-open the next bag. The web is disengaged by the engagement member. The next bag is opened with air for loading.

14 Claims, 15 Drawing Sheets

PACKAGING MACHINE

RELATED APPLICATIONS

This application claims priority to U.S. Provisional Application No. 60/971,761 filed Sep. 12, 2007, the entire disclosure of which is incorporated herein by reference.

FIELD OF THE INVENTION

The present invention relates generally to packaging and in particular to a method and apparatus for forming packages without assistance from a source of pressurized air.

BACKGROUND OF THE INVENTION

Various methods and apparatus for packaging articles in plastic bags are available. In one packaging method, the bags form part of a continuous plastic web. Each bag is connected to an adjacent bag along a line of weakness. Typically, the bags define an opening on one face through which the bag is loaded. Some existing bagging machines are powered by both electricity and compressed air. One advantage of bagging machines that utilize compressed air is that a powerful burst of air can be provided at the opening of the bag to separate the plies of the bags and open the bags for loading.

SUMMARY

The present application discloses methods and apparatus for forming packages from a web of preformed bags. In one exemplary method of forting packages from a web of preformed bags, a first bag is held open with air. A product is loaded into the first bag that is held open with air. An opening of the first bag is sealed. A next bag is indexed such that an opening of the next bag is proximate to an engagement member. The web is engaged with the engagement member. The web may be reverse indexed to pre-open the next bag. The web is disengaged by the engagement member. The next bag is opened with air for loading.

This method can be performed by a wide variety of different apparatus. In one exemplary embodiment, the apparatus comprises a supply of a web of preformed bags. An indexing mechanism moves the web along a path of travel. A blower is positioned to sequentially blow air into the bags of the web to open the bags. An engagement member is moveable from an engaged position where the engagement member engages the web and a disengaged position where the engagement member is spaced apart from the web. A sealer seals loaded bags to form packages. A controller is in communication with the indexing mechanism, the engagement member, and the sealer. The controller is programmed to actuate the sealer to seal an opening of the first bag, index a next bag such that an opening of the next bag is proximate to the engagement member, and engage the web with the engagement member and reverse index the web to pre-open the next bag.

DETAILED DESCRIPTION

Figure 1:
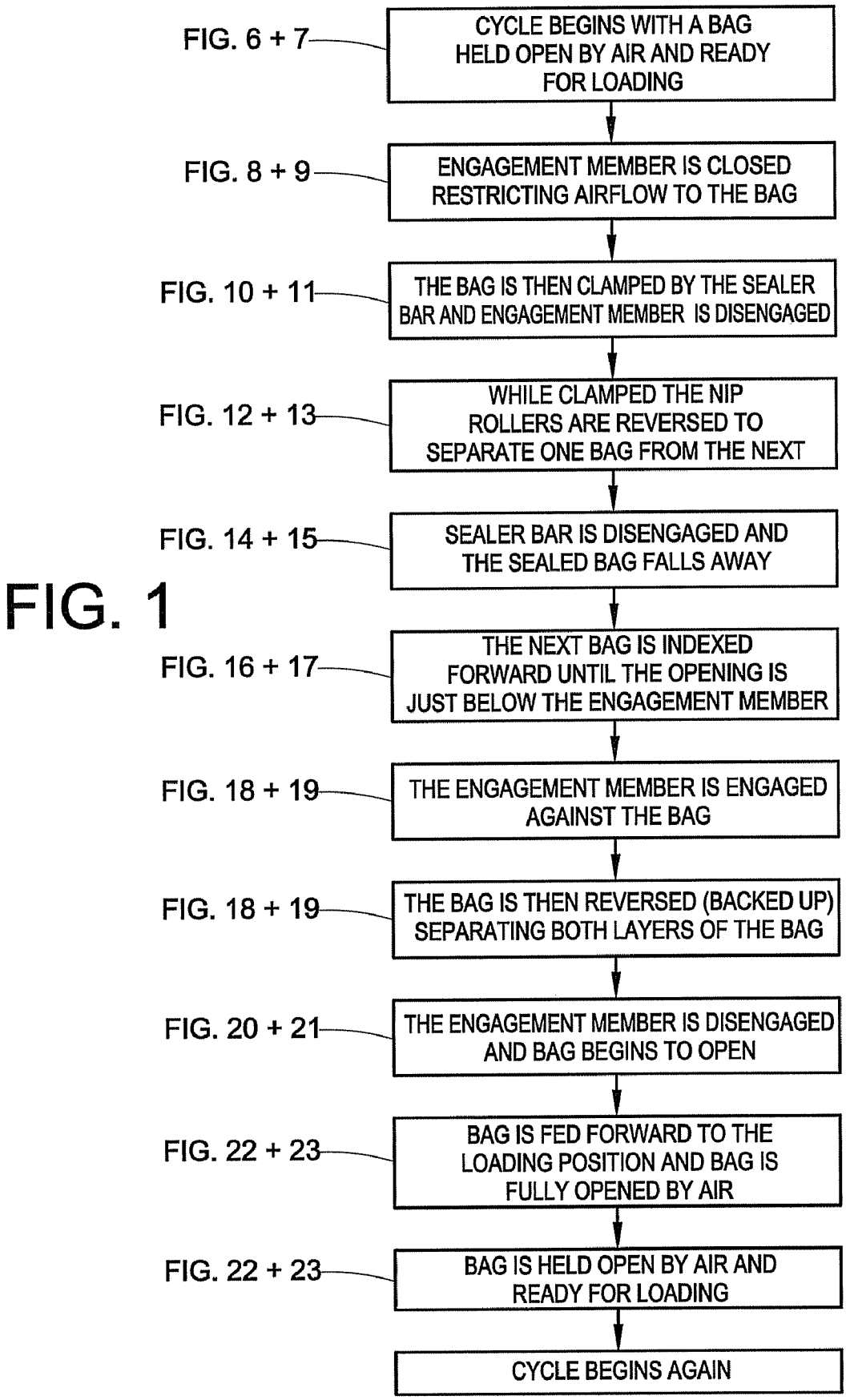
FIG. 1 is a flow chart that illustrates a process of loading bags with a product, sealing the bags, and separating the bags from a web of bags.

The present application relates to a method 8 (FIG. 1) and apparatus 10 (FIGS. 4 and 5) for malting packages 12 (FIGS. 2 and 3) from an elongated web 16 (FIGS. 1A and 2A) of preformed interconnected bags 18. In an exemplary embodiment, the web 16 is engaged to move one ply of the web with respect to the other ply of the web to "pre-open" the bag and make opening of the bag 18 with air to receive products easier. As a result, air moving at a lower volumetric flow rate can be used to open the bags. For example, air provided by a relatively small electric fan or blower can be used to open the "pre-opened" bag, instead of air provided under relatively high pressure by an air compressor. In one embodiment, the apparatus 10 is powered solely by electricity, is not connected to a source of pressurized air, and does not include an air compressor.

The packages 12 can be made from a wide variety of different types of webs 16 of preformed interconnected bags 18. In the example illustrated by FIGS. 1A and 1B, each preformed bag 18 is defined by first and second plies 20, 22 of the web 16. First and second side edges 24, 26 of the web hermetically join the first and second plies. Preformed seals 28 extend between the first and second side edges 24, 26. A line of separation 30, such as a cut in the first ply extends between the first and second side edges 24, 26. A line of weakness 32, such as a line of perforations in the second ply extends between the first and second side edges 24, 26. The web 16 of preformed bags 18 illustrated by FIGS. 1A and 1B is one example of the wide variety of different webs that may be used. Examples of acceptable webs of preformed interconnected bags include, but are not limited to, the webs disclosed in U.S. Pat. No. 3,254,828 to H. Lemer and U.S. Pat. No. 5,957,824 to B. Lemer et al., which are incorporated herein by reference in their entirety.

The web may be formed of any suitable material. Examples of suitable materials include, but are not limited to, plastic materials, polyethylene, cellophane, vinyl films, pliofilms, cellulose acetate film, polystyrene, polypropylene, and any heat sealable material.

Figure 3:
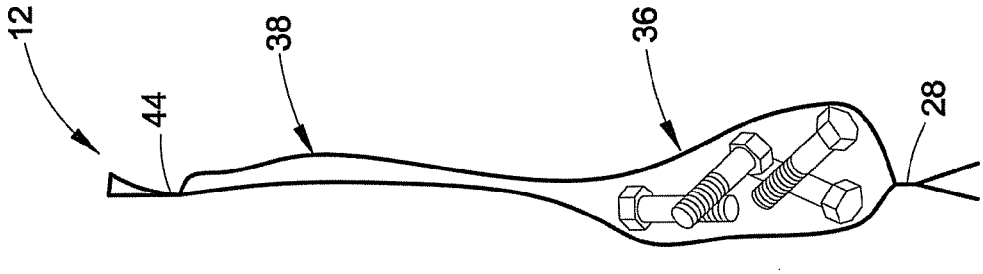
FIG. 3 is a view of the package taken along lines 3-3 in FIG. 2.
Figure 2:
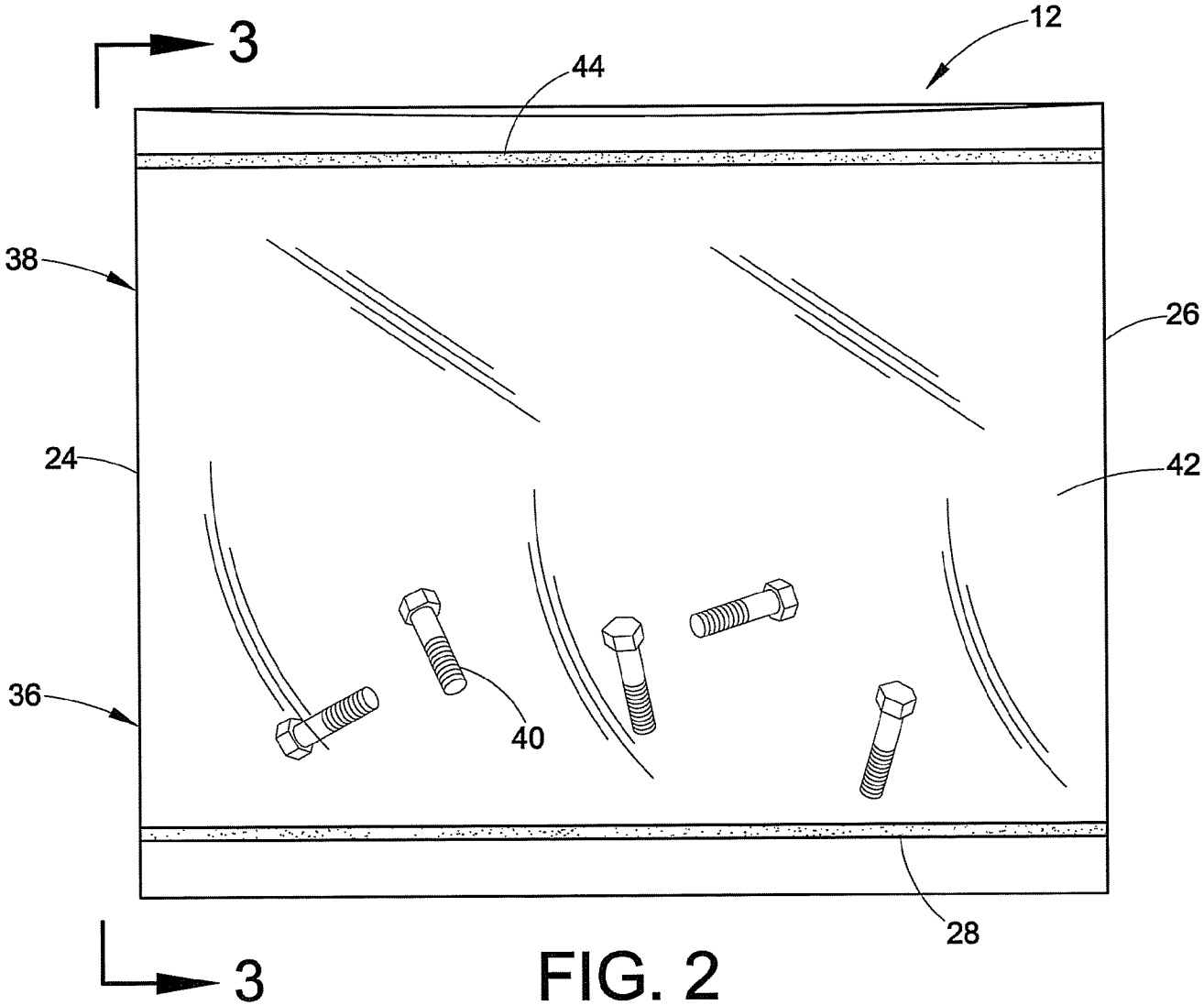
FIG. 2 is a view of an exemplary package.

Referring to FIGS. 2 and 3, an exemplary package 12 includes a sealed compartment 36. The package 12 may have any number of compartments. Product 40 is disposed in the compartment 36. The illustrated product 40 is a plurality of bolts. However, the package 12 may contain any product. The compartment is defined by the first and second side edges 24, 26, the preformed seal 28, and a seal 44 that is formed after the product 40 is loaded into the bag. In the example, the seal 44 extends from the first side edge 24 to the second side edge 26 to hermetically seal the compartment 36. In another embodiment, the dividing seal 28 may not extend all the way from the first side edge to the second side edge or may be intermittent to allow communication between the compartment 44 and external air or the compartment 44 and another optional compartment of the package.

Figure 1A:
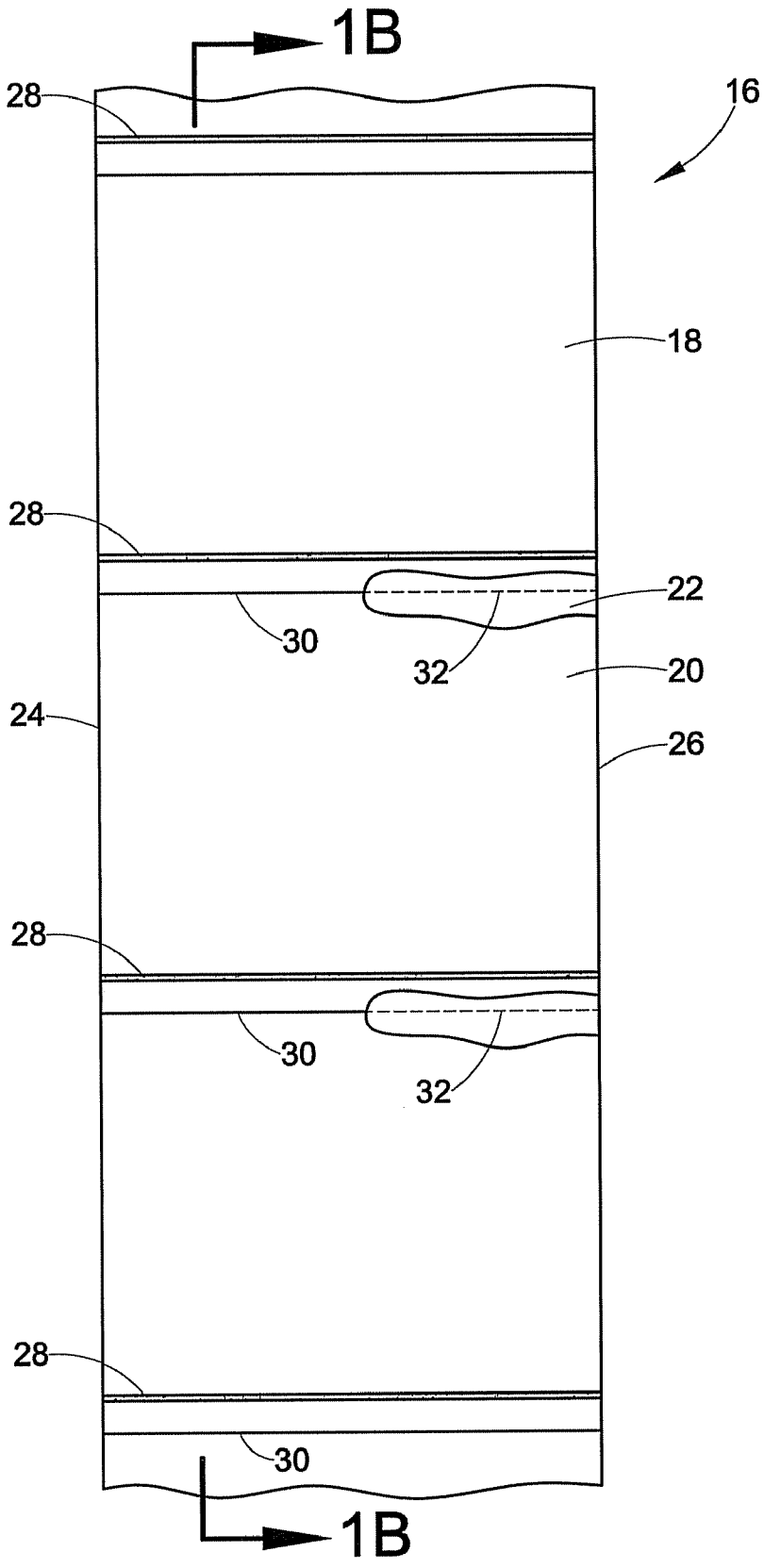
FIG. 1A is a schematic illustration of an exemplary elongated web of preformed interconnected bags.
Figure 1B:
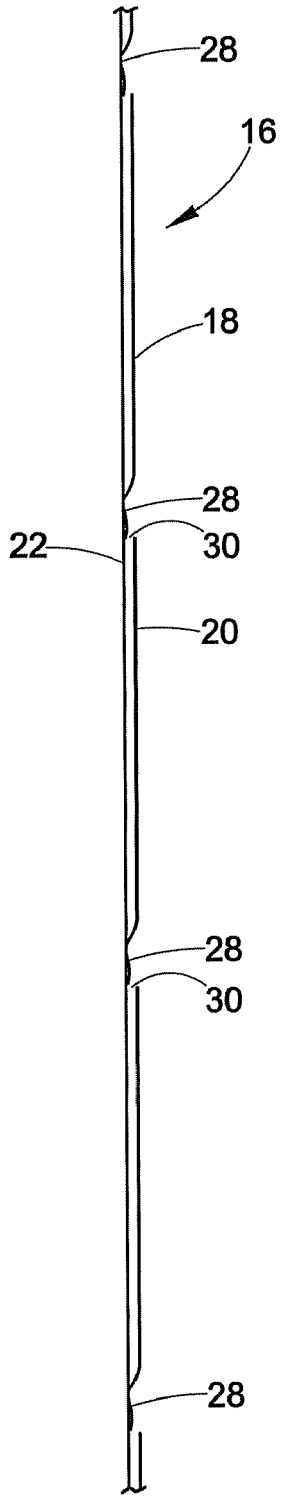
FIG. 1B is a view of the elongated web taken along lines 1B-1B in FIG. 1A.

FIG. 1 is a flow chart 14 that illustrates a method 8 of making packages. Any one or more of the steps of the method illustrated by FIG. 1 may be omitted and/or the order of the steps may be changed without departing from the spirit and the scope of the present invention. That is, steps of the method illustrated by FIG. 1 may be omitted, modified or reduced. For example, any method that moves one layer 22 with respect to the other layer 20 (or vice versa) to allow the bags to be more easily opened with air can be used. The flow chart refers to the apparatus 10 shown in FIGS. 4-23 being operated to make packages 12 from an elongated web 16 of preformed interconnected bags 18. However, any apparatus can be used that performs the method shown in FIG. 1. The concept of the apparatus 10 can be implemented in any of a wide variety of packaging machines. For example, U.S. Pat. No. 3,254,468 to H. Lemer, U.S. Pat. No. 4,928,455 to Gereby et al., U.S. Pat. No. 5,341,625 to Kramer, U.S. Pat. No. 5,394,676 to B. Lerner et al., U.S. Pat. No. 6,543,201 to Cronauer et al., U.S. Pat. No. 6,742,317, U.S. Pat. No. 5,394,676, U.S. Pat. No. 5,371,521, and U.S. Pat. No. 4,899,520 disclose packaging machines that can be modified in accordance with the present invention to make packages from an elongated web of preformed interconnected bags and are all incorporated herein by reference in their entirety.

Referring now to FIGS. 4-7, the illustrated apparatus 10 includes a supply 50 (FIG. 6) of the elongated web 16 of preformed interconnected bags 18, an indexing mechanism 52, an opening arrangement 54, a sealing arrangement 56, and a controller 58. The supply 50 comprises the elongated web 16 that is rolled or folded to stage a relatively large amount of the web in a relatively small space. The web 16 is routed from the supply 50 along a path of travel P to the indexing mechanism 52. The indexing mechanism 52 receives the web 16 from the supply and moves the web along the path of travel P. The indexing mechanism 52 may take a wide variety of different forms. For example, any indexing mechanism that can be controlled to index bags of the web to selected positions along the path of travel may be used. In the illustrated example, the indexing mechanism comprises a pair of rollers 60 that form a nip that engages the web 16. The rollers 60 are selectively driven by a motor (not shown) to index bags of the web to selected positions along the path of travel P.

Figure 5:
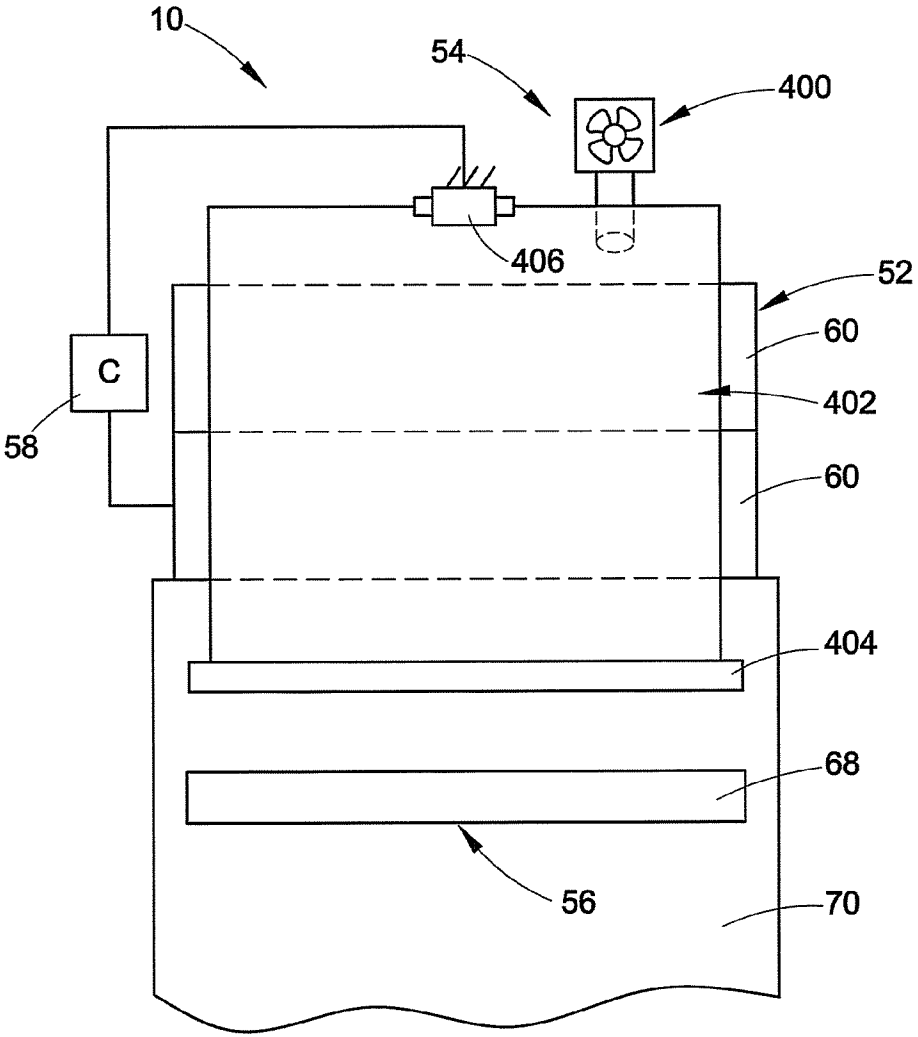
FIG. 5 is a view of the apparatus taken along lines 5-5 in FIG. 4.
Figure 4:
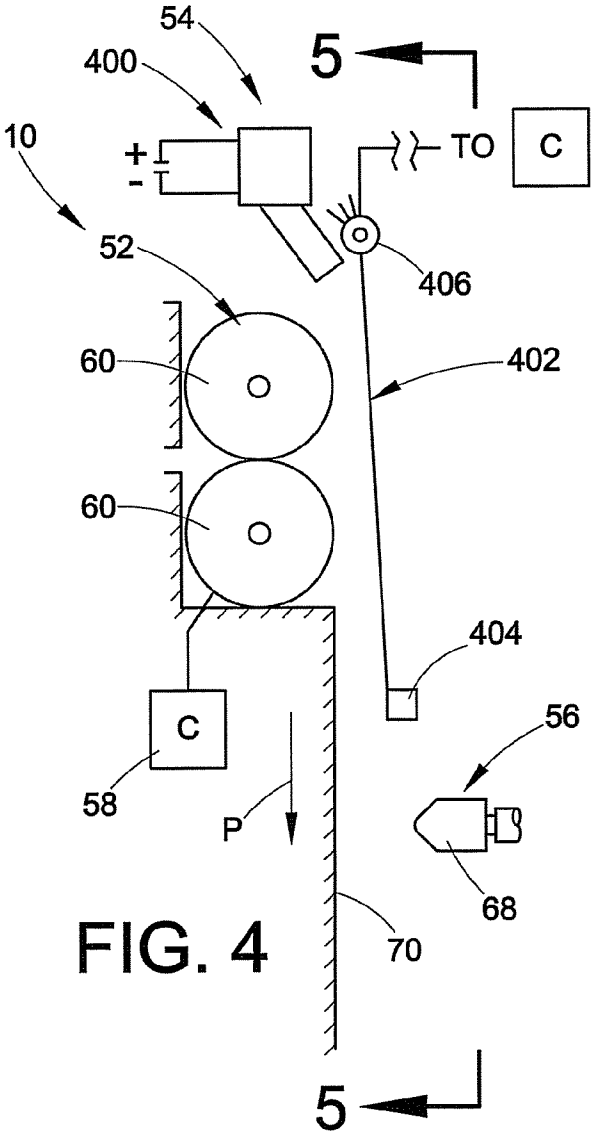
FIG. 4 is a schematic illustration of an exemplary apparatus for making packages from an elongated web of preformed interconnected bags.

Referring to FIGS. 4 and 5, the opening arrangement 54 is positioned along the path of travel P to open each bag that is to be loaded and sealed. In the illustrated embodiment, the opening arrangement 54 comprises a blower 400 and an engagement device 402. However, the opening arrangement 54 may take a wide variety of different forms.

Referring to FIGS. 4 and 5, the controller 58 is in communication with the indexing arrangement 52, the opening arrangement 54, and the sealing arrangement 56. The controller 58 controls the indexing arrangement 52, the opening arrangement 54, and the sealing arrangement 56 to convert the preformed bags 18 into packages 12. A wide variety of controllers can be used and programmed to control the indexing arrangement 52, the opening arrangement 54, and the sealing arrangement 56 as described herein. For example, the controller and controller algorithms described in U.S. Pat. No. 5,341,625 to Kramer can be modified to control the indexing arrangement 52, the opening arrangement 54, and the sealing arrangement 56 to perform the method 8 of forming packages.

Figure 7:
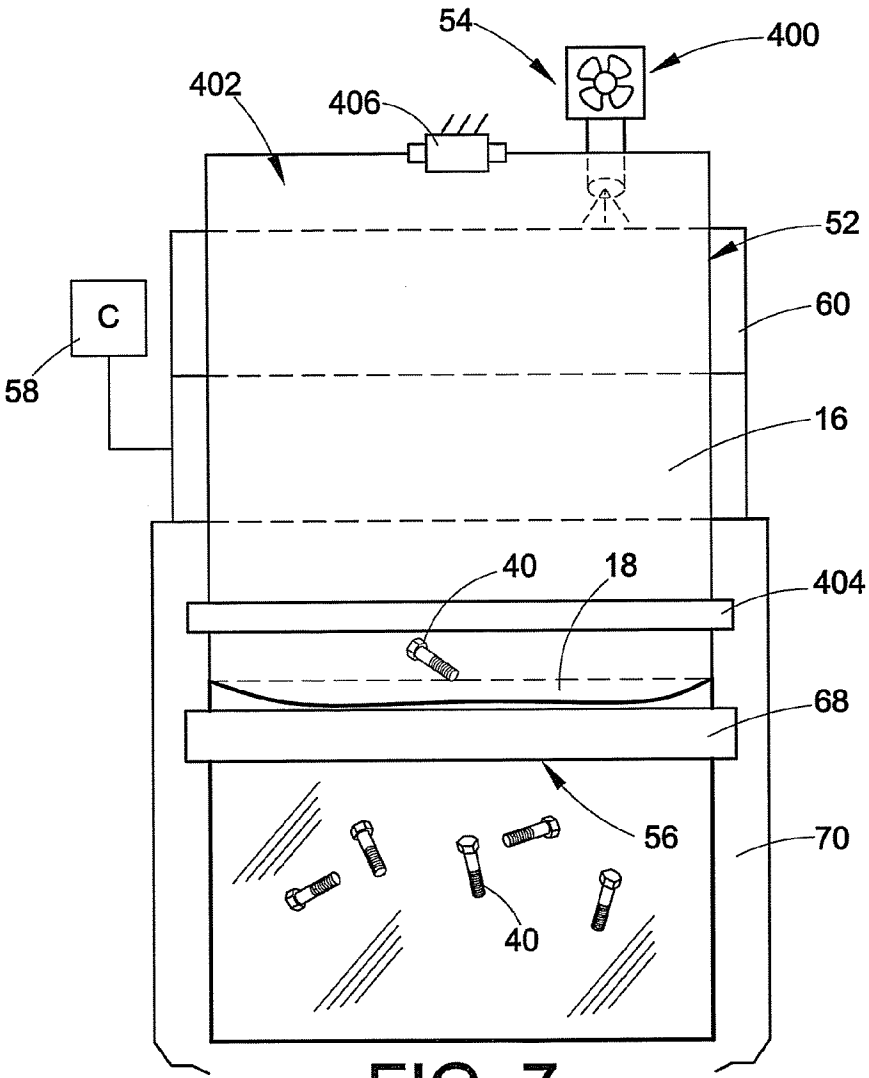
FIG. 7 is a view of the apparatus taken along lines 7-7 in FIG. 6.
Figure 6:
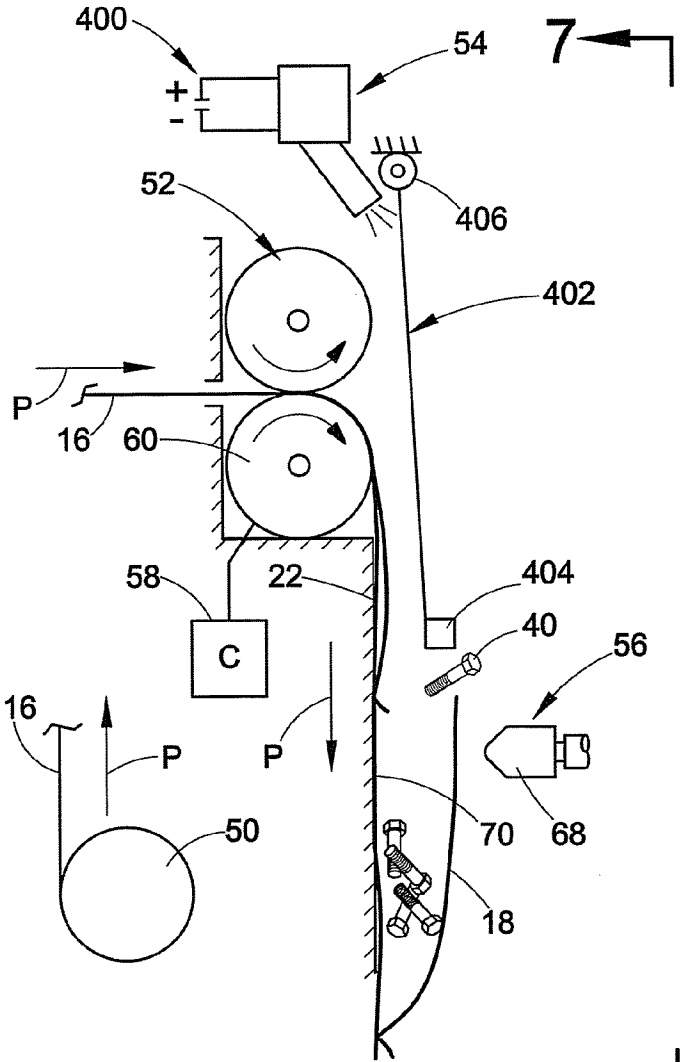
FIG. 6 is a schematic illustration of the apparatus with the bag in an open condition for loading with a product.

Referring to FIGS. 1, 6 and 7, each bag 18 is held open with air at a position where the bag is loaded with a product 40. The opening of the bags 18 is described in more detail below. When the bag 18 is positioned at the load position and is held open by air, the product 40 is loaded into the bag 18. The product may be loaded manually or automatically. In the illustrated embodiment, the position where the bag 18 is loaded is also the position where bag 18 is sealed. In another embodiment the position where the bag is loaded is different than the position where the bag is sealed. In this embodiment, the controller 58 causes the indexing mechanism 52 to move the bag 18 to the seal position after the bag is loaded with product 40.

In an exemplary embodiment, once the product is loaded in the bag 18, an operator may provide a signal to the controller 58 that indicates that loading is complete or completion of loading may be automatically detected. The apparatus 10 may be configured to allow the operator to provide the completed loading signal to the controller in a wide variety of different ways. For example, the apparatus may have a control foot pedal (not shown) or the sealing arrangement 56 may have a portion that the operator can push on to indicate that loading is complete and it is time to seal the package. Similarly, the apparatus can be configured to automatically detect completed loading and provide the controller with a signal that indicated this fact. For example, the apparatus may include a counter or may weigh the package to detect completed loading. The signal from the operator or detection of completed loading is communicated to the controller 58, which may cause actuation of both the engagement device 402 as shown in FIGS. 8 and 9 and the sealing arrangement 56 as shown in FIGS. 10 and 11 as described in more detail below.

Figure 9:
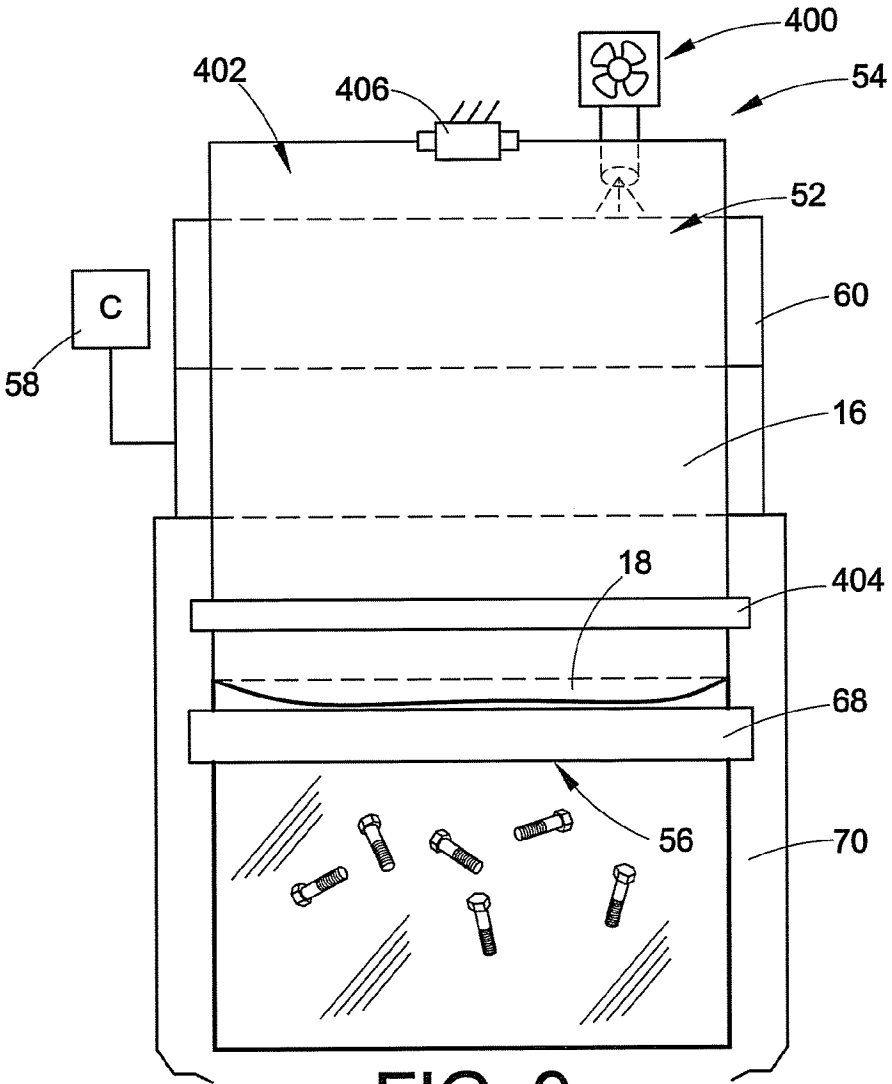
FIG. 9 is a view of the apparatus taken along lines 9-9 in FIG. 8.
Figure 8:
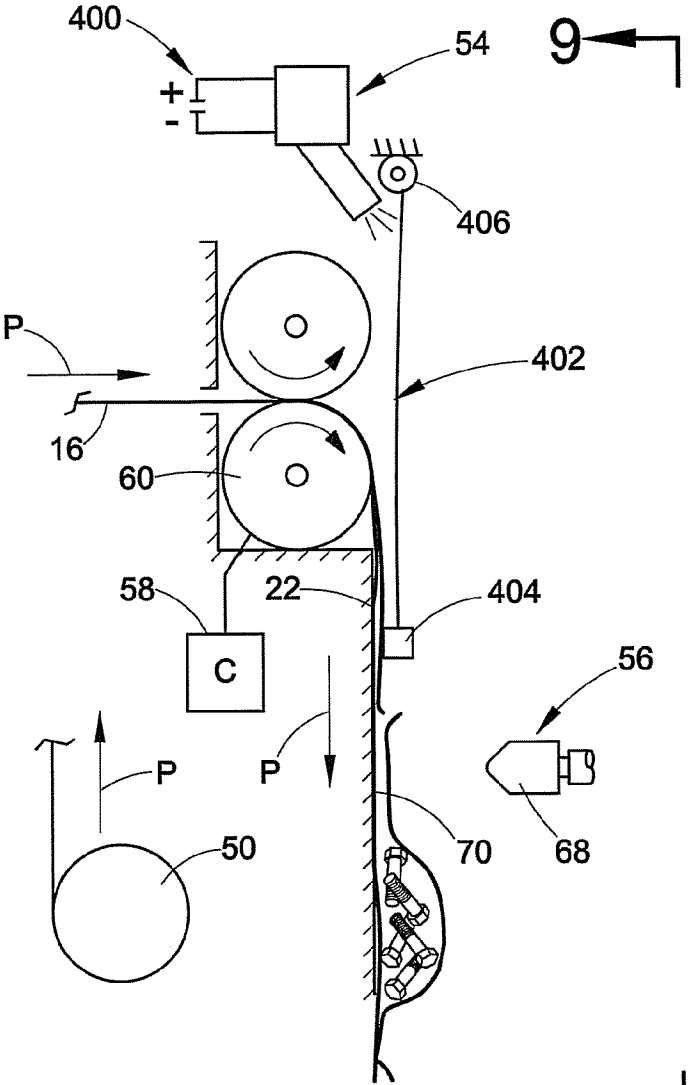
FIG. 8 is a schematic illustration of the apparatus with an engagement member positioned to reduce a volume of air in the loaded bag.

Referring to FIGS. 8 and 9, once in the seal position, the controller 58 optionally causes a motor or actuator 406 of the engagement device 402 to move an engagement member 404 into engagement with the web 16. The engagement between the engagement member 404 and the web 16 inhibits further air from the blower 400 from moving into the open bag 18, and thus functions as an air restrictor. As a result, the amount of air in the bag 18 diminishes as illustrated by FIG. 8 before the seal is formed.

Figure 11:
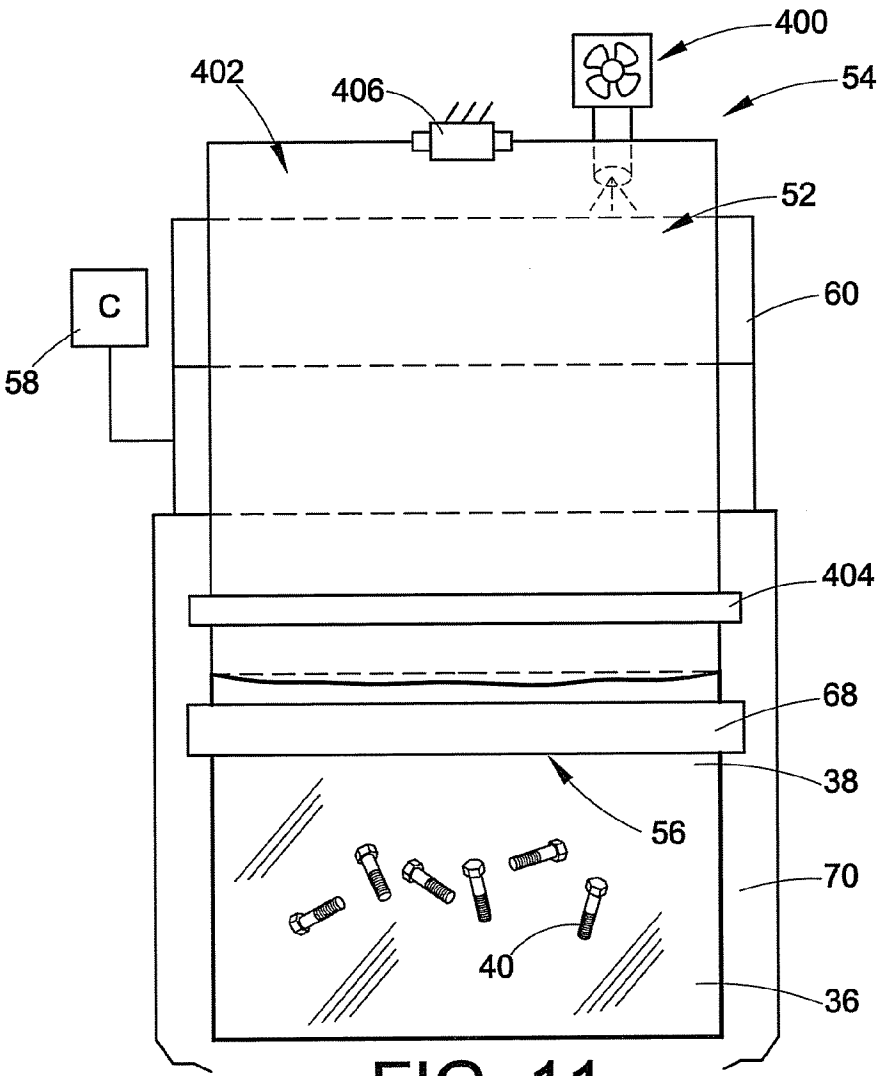
FIG. 11 is a view of the apparatus taken along lines 11-11 in FIG. 10.
Figure 10:
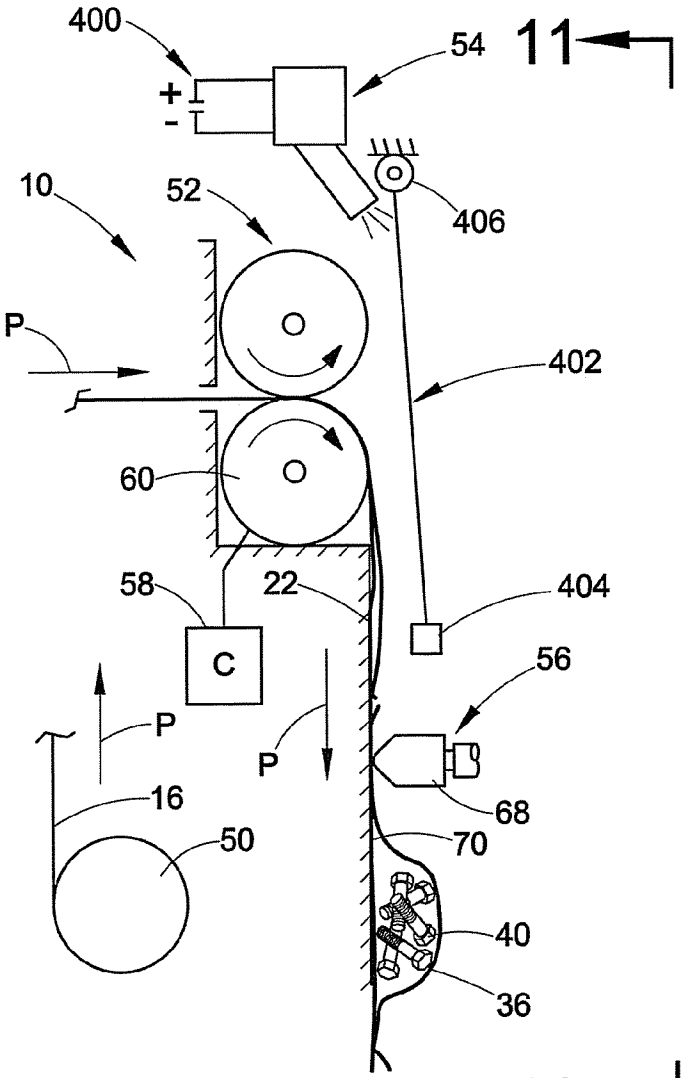
FIG. 10 is a schematic illustration of the apparatus with the bag being sealed to enclose the product in the package.

Referring to FIGS. 10 and 11, the sealing arrangement 56 is positioned along the path of travel P to provide the seal 44 (FIG. 2). The sealing arrangement 56 may take a wide variety of different forms. For example, any mechanism that applies heat to the web to seal the first and second webs together to form the seal 44 may be implemented. In the illustrated embodiment, the sealing arrangement comprises a heated bar 68 that is selectively moved into and out of engagement with a base member 70. When the web is in the seal position, the controller 58 controls the sealing arrangement 56 to clamp the web 16 between the heated bar 68 and the base member 70. Heat is applied to the web to seal the plies of the web together between the first side edge 24 and the second side edge 26. The first and second plies 20, 22 are sealed together to form the compartment 36. In the exemplary embodiment, the controller 58 causes the motor or actuator 406 of the engagement device 402 to move the engagement member 404 away from the web 16 once the web 16 is clamped by the heated bar.

Figure 13:
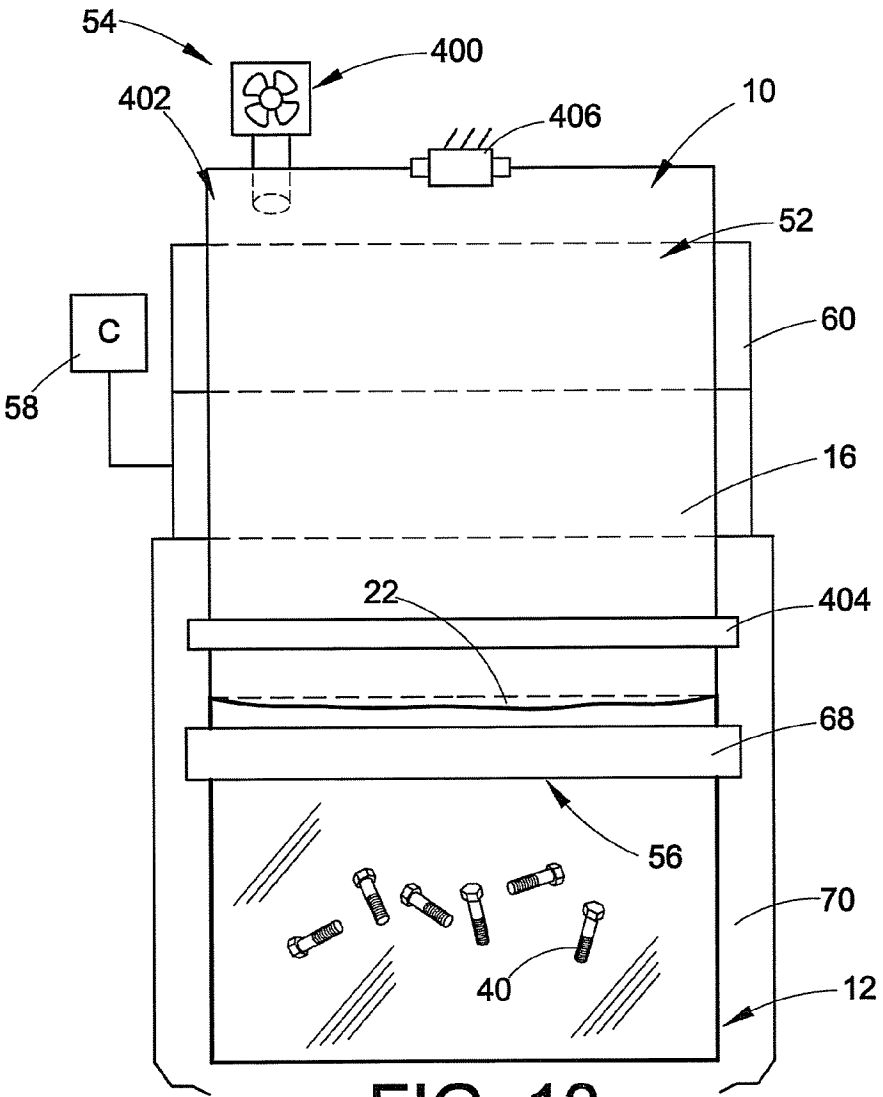
FIG. 13 is a view of the apparatus taken along lines 13-13 in FIG. 12.
Figure 12:
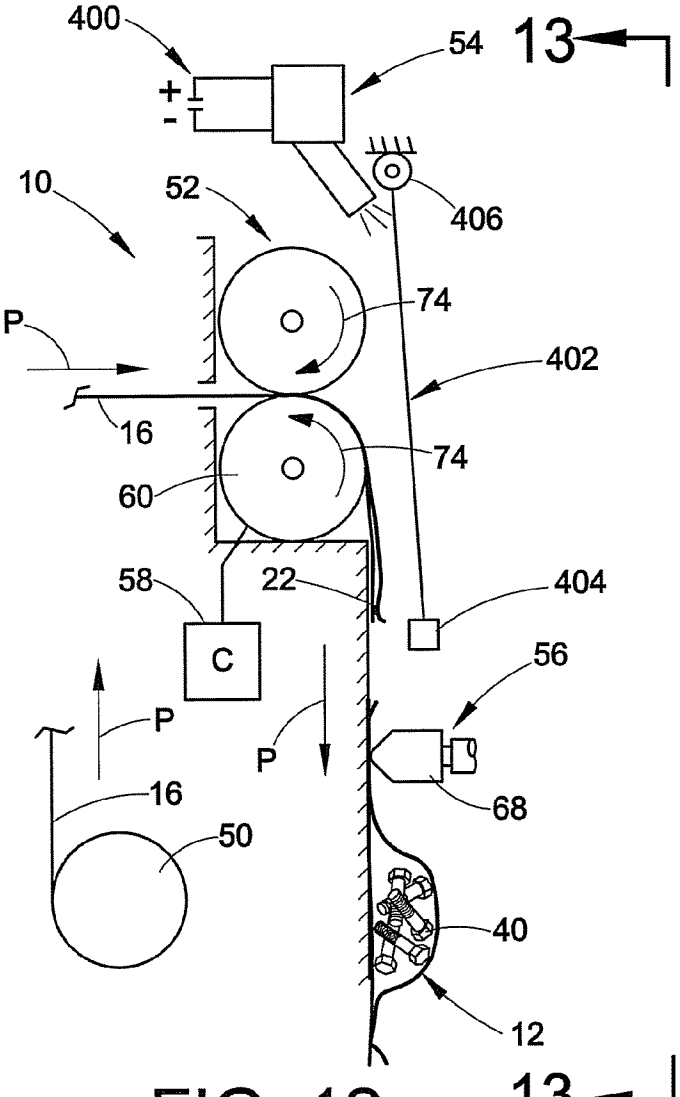
FIG. 12 is a schematic illustration of the apparatus pulling the web away from the loaded bag to separate the loaded bag from the web.
Figure 15:
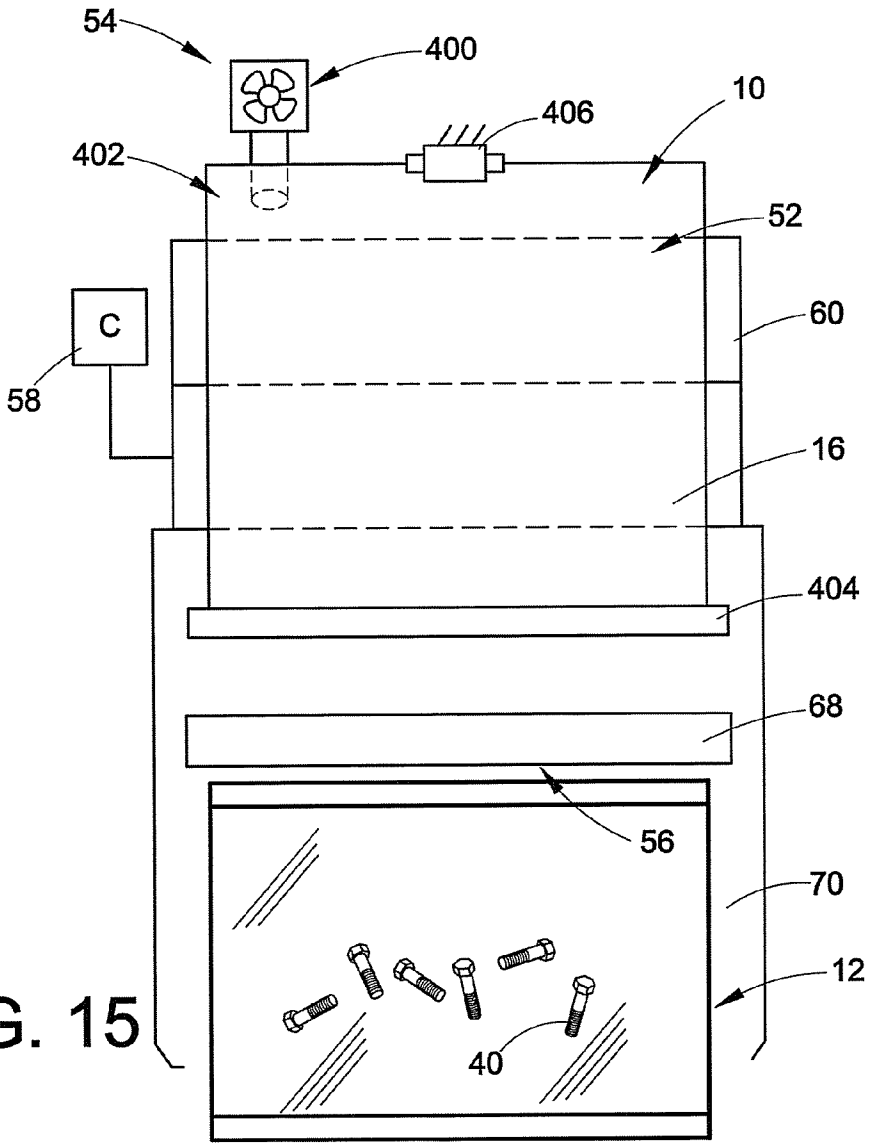
FIG. 15 is a view of the apparatus taken along lines 15-15 in FIG. 14.
Figure 14:
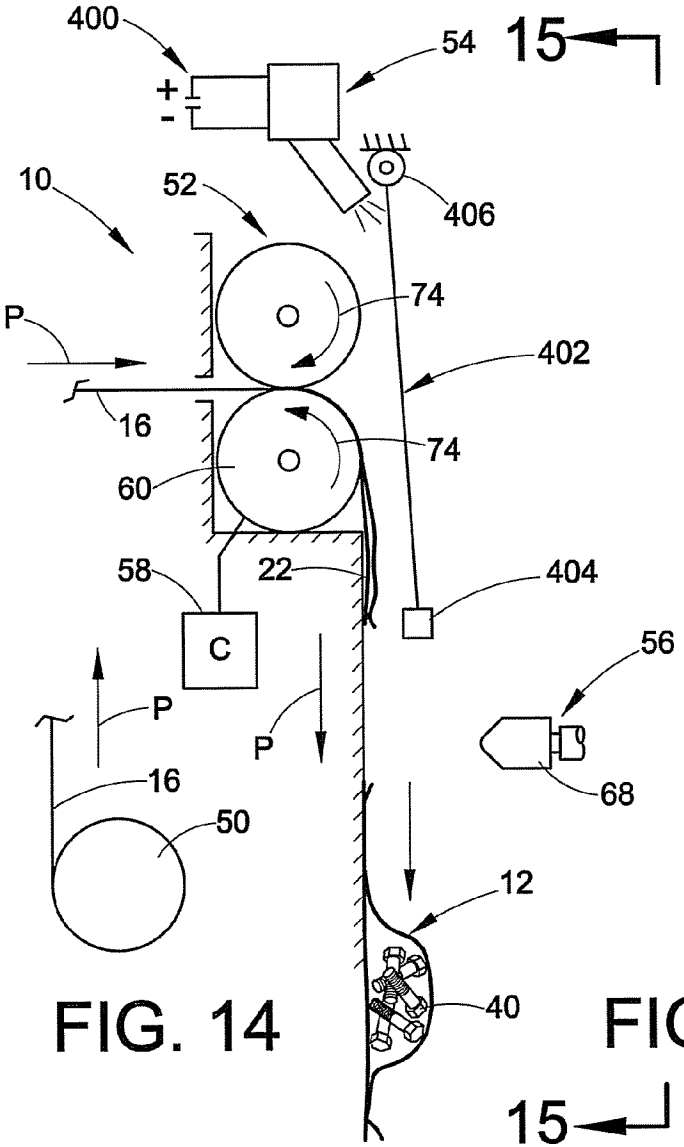
FIG. 14 is a schematic illustration of the apparatus releasing an exemplary package.

Referring to FIGS. 12 and 13, the controller 58 controls the indexing mechanism 52 to separate the formed package 12 from the web 16. The second ply 22 is broken along the line of weakness 32 to separate the package 12 from the elongated web 16 of interconnected bags 18. The controller 58 controls the indexing arrangement 52 to pull the web 16 away from the bag 18 as indicated by arrows 74 while the bag is clamped by the sealing arrangement 56 in an exemplary embodiment. The bag 18 breaks free of the web 16 along the line of weakness 32. Referring to FIGS. 14 and 15, the controller 58 controls the sealing arrangement 56 to release the formed package 12.

Figure 17:
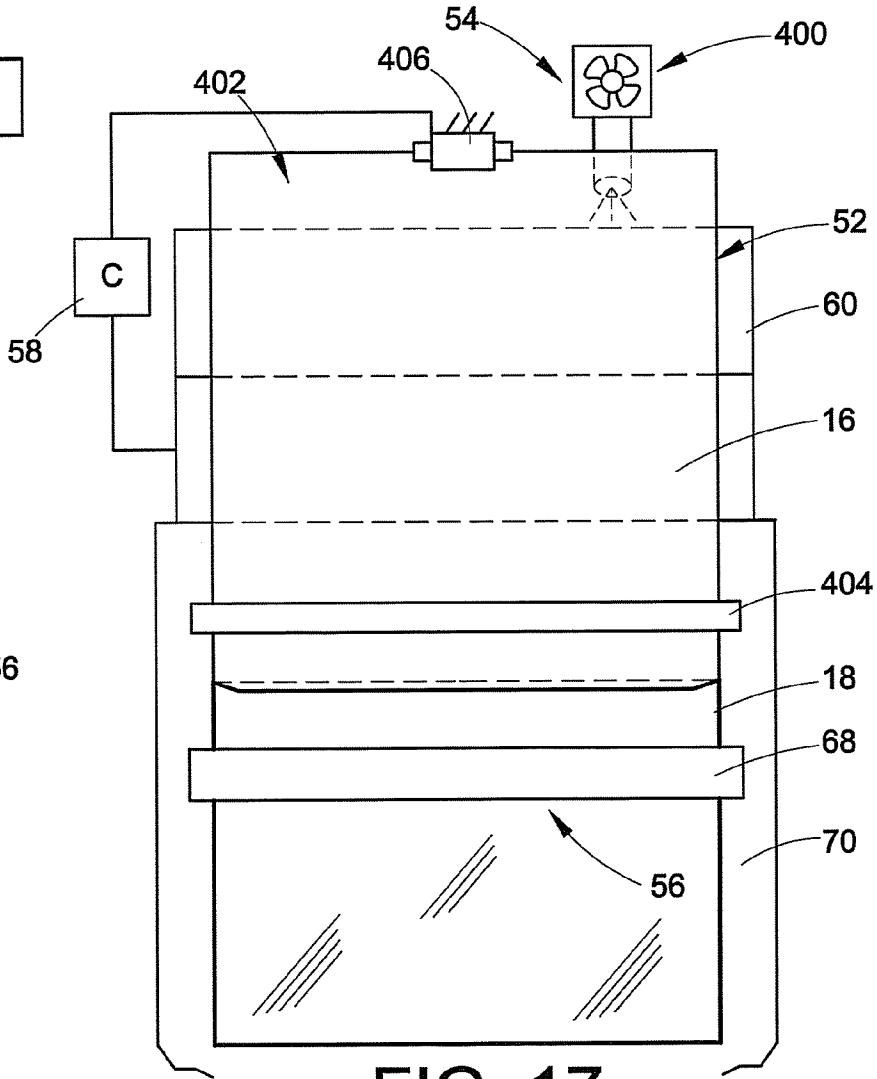
FIG. 17 is a view of the apparatus taken along lines 17-17 in FIG. 16.
Figure 16:
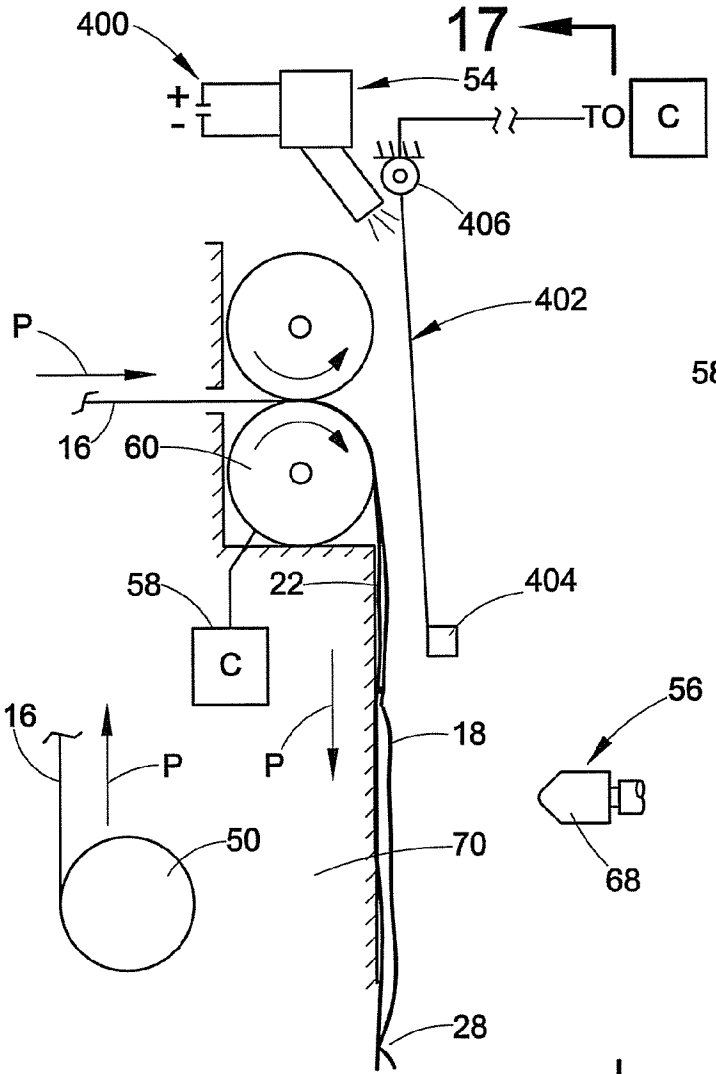
FIG. 16 is a schematic illustration of the apparatus with a bag positioned for pre-opening by engagement with an engagement member.

Referring to FIGS. 16 and 17, the controller 58 controls the indexing mechanism 52 to index the web 16 forward until the opening 30 of the next bag 18 is just below the engagement member 404 of the engagement device 402 in the exemplary embodiment. In alternate embodiments, the opening 30 is indexed to other positions. The opening 30 can be indexed to any position where engagement of the web by the engagement member 404 and/or movement of the web by the indexing arrangement 52 causes the bag to pre-open. For example, the opening 30 may be substantially aligned with the engagement member 404 402 or the opening may be positioned slightly above the engagement member.

Figure 19:
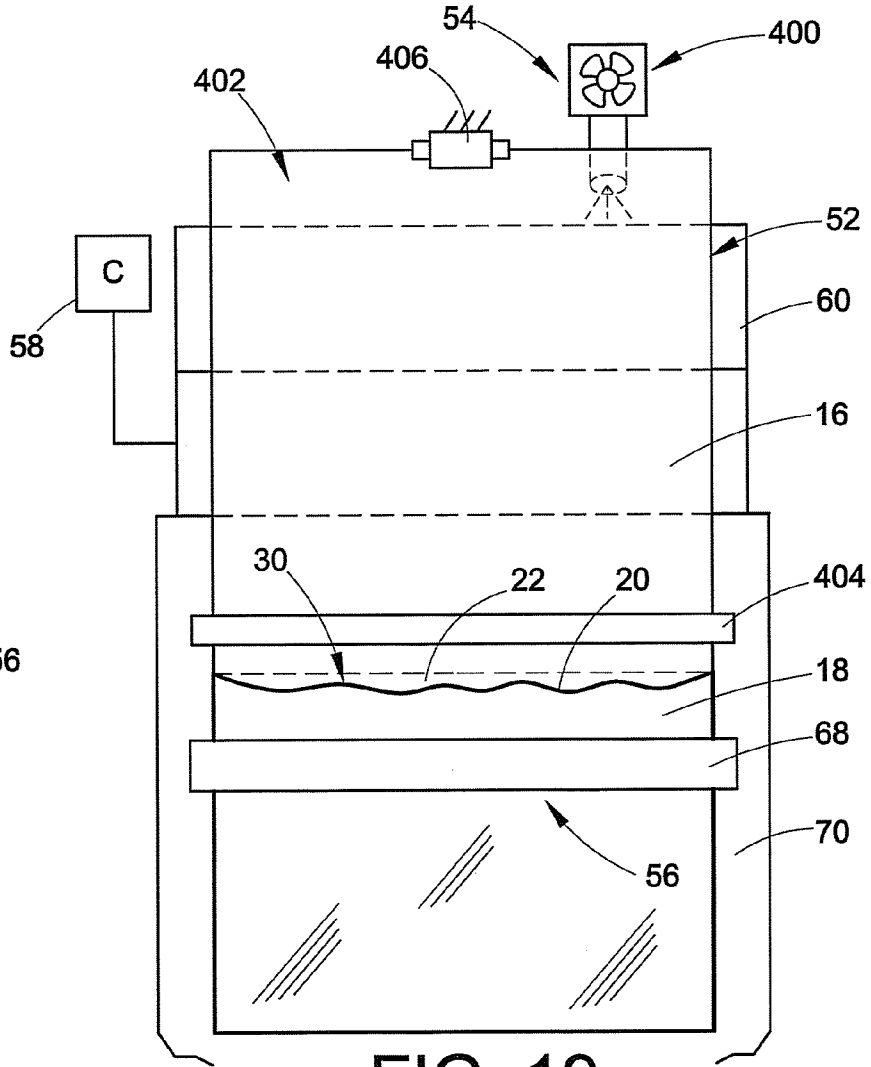
FIG. 19 is a view of the apparatus taken along lines 19-19 in FIG. 18.
Figure 18:
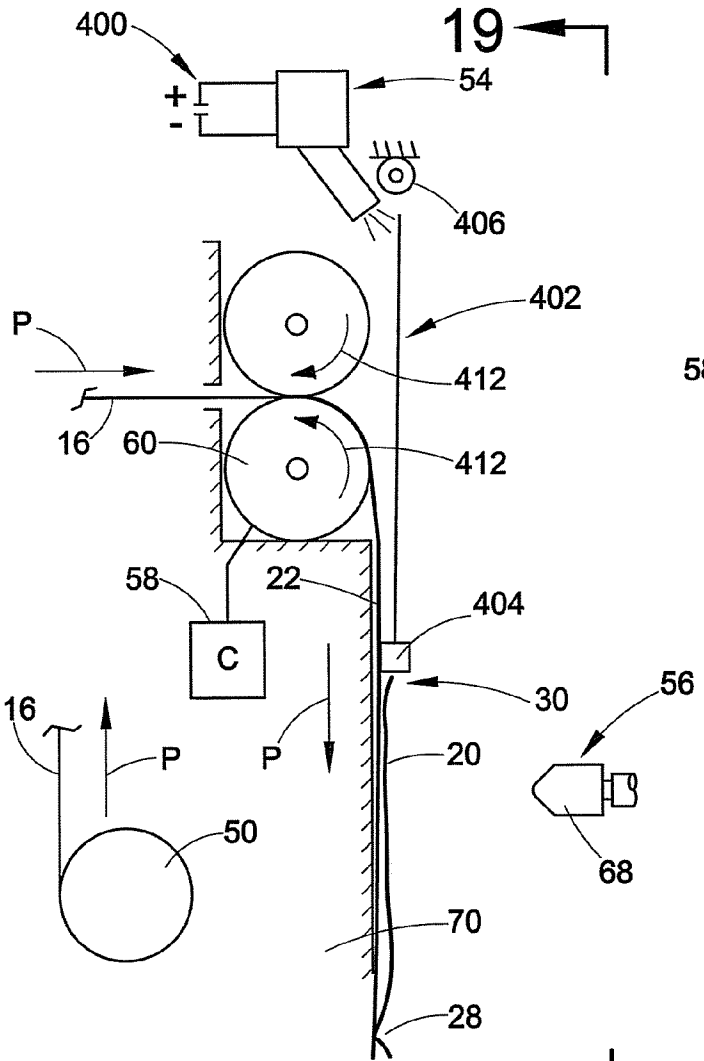
FIG. 18 is a schematic illustration of the apparatus with a bag being pre-opened by engagement with an engagement member and reverse indexing of a drive.

Referring to FIGS. 18 and 19, the controller 58 then causes the motor or actuator 406 of the engagement device 402 to move the engagement member 404 into engagement with the web. The engagement of the web 16 with the engagement member 404 alone can be configured to cause the layers 20, 22 of the web to move relative to one another to pre-open the bag and facilitate easy opening of the bag with air. In an exemplary embodiment, the controller 58 causes the indexing mechanism 52 to pull on the web as indicated by arrows 412 while the engagement member 404 is in engagement with the web 16 to cause the layers 20, 22 to move with respect to one another and pre-open the bag. In another embodiment, the indexing mechanism moves the web in the opposite direction to pre-open the bag.

The relative movement of the layers 20, 22 of the web may manifest in a wide variety of different ways. FIG. 19 shows that the layer 20 may wrinkle or pucker at the opening 30 when the web is pulled against the engagement member 404. This wrinkling or puckering creates enough of a space between the two layers at the opening 30 that a small amount of air flow will easily open the bag 18 for filling. The engagement between the engagement member 404 and the web 16 can be at any location on the web that facilitates movement of the two layers 20, 22 at the opening. For example, the engagement can occur a significant distance from the opening 30 and still facilitate movement of the layers 20, 22 at the opening to pre-open the bag 18. In an embodiment, a separate engagement device that is used for pre-opening of the bags is included in addition to an engagement device that is used to reduce the amount of air in the package after the bag is loaded as described above. In another embodiment, the engagement device 402 does not function to reduce the amount of air on the loaded package and the engagement device functions primarily to engage the web to facilitate pre-opening of the web as described above.

The engagement device 402 can take a wide variety of different forms. The engagement device 404 may be a pneumatic, hydraulic, or electric actuator with an extendable portion that engages the web to pre-open the bags or a driven cam that rotates to engage the web and pre-open the bags. The engagement device 404 can be any device that moves to engage the web to pre-open the bags.

Figure 25:
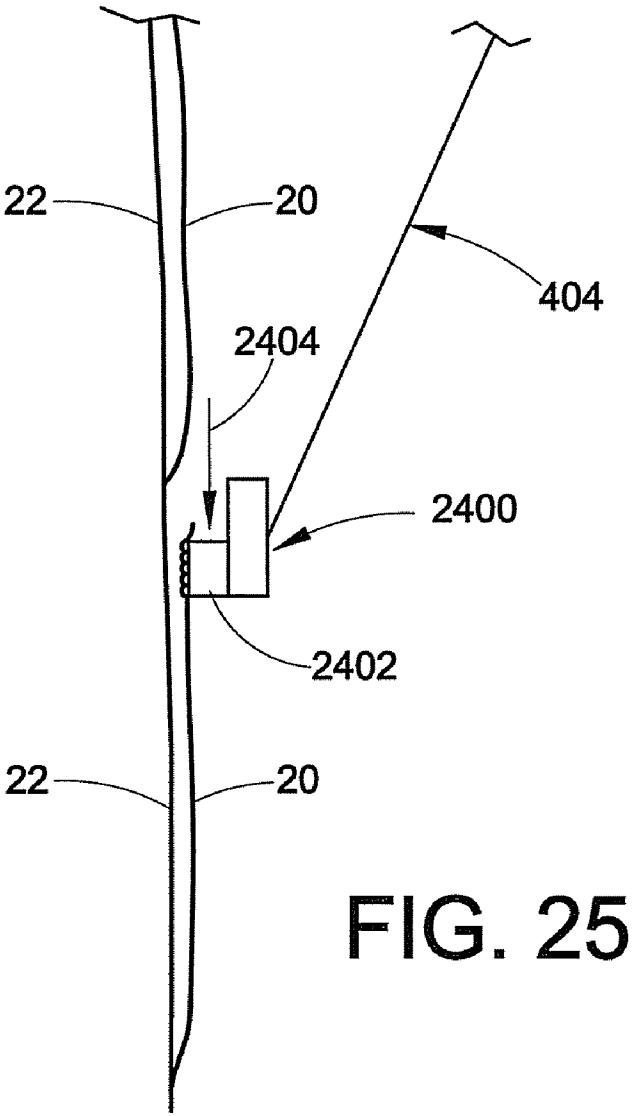
FIG. 25 illustrates an engagement member with an optional device that helps the engagement member pre-open the bags with the engagement member in contact with the web.
Figure 24:
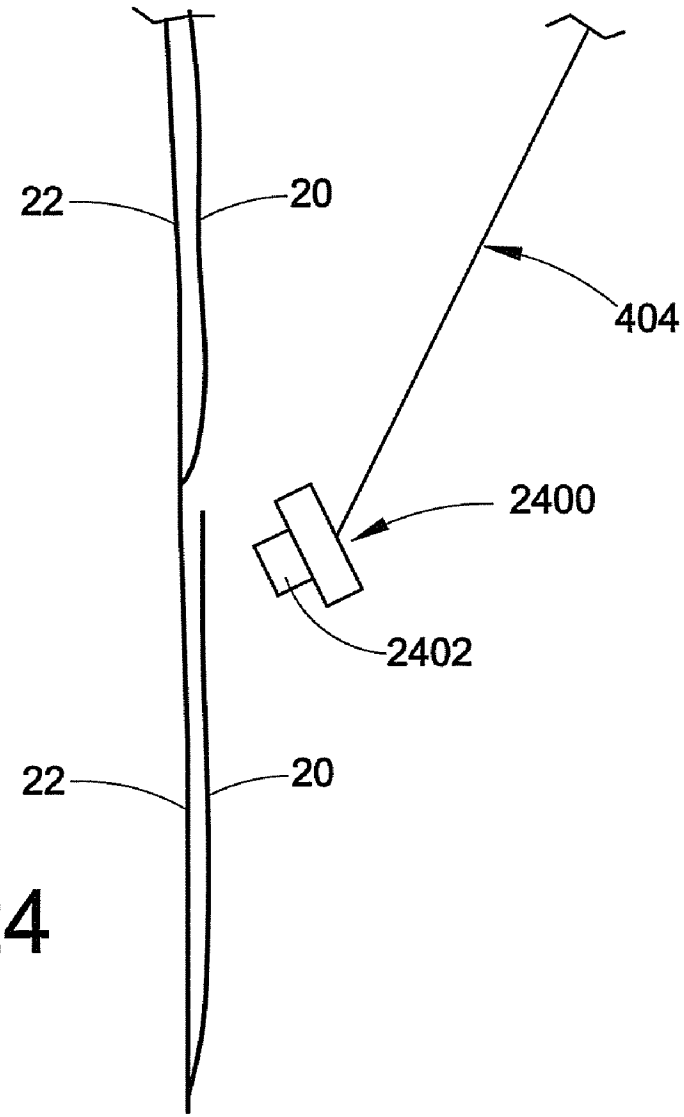
FIG. 24 illustrates an engagement member with an optional device that helps the engagement member pre-open the bags with the engagement member spaced apart from the web.
Figure 27:
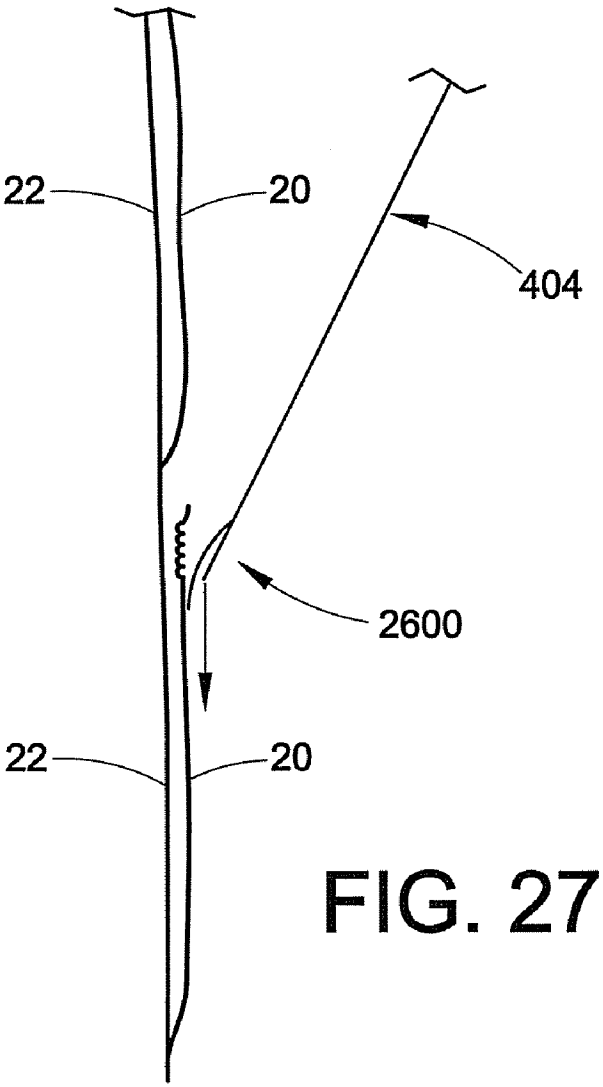
FIG. 27 illustrates an engagement member with an optional member that helps the engagement member pre-open the bags with the engagement member in contact with the web.
Figure 26:
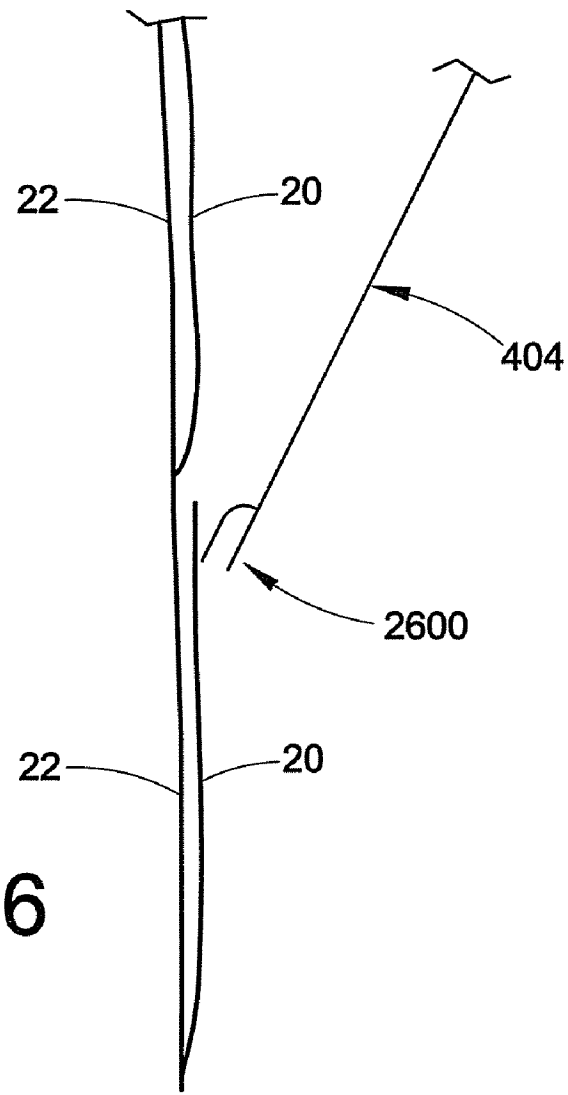
FIG. 26 illustrates an engagement member with an optional member that helps the engagement member pre-open the bags with the engagement member spaced apart from the web.

Referring to FIGS. 24-27, in some embodiments the indexing arrangement is not reversed to pre-open the bags and the engagement device includes an optional device 2400 (FIGS. 24 and 25) or member 2600 (FIGS. 26 and 27) that helps the engagement member 404 pre-open the bags. Referring to FIGS. 24 and 25, the optional device 2400 may be a powered device with a portion 2402 that forces the front layer 20 of the web upward or downward when the engagement member 404 engages the web. In the example illustrated by FIGS. 24 and 25, the portion 2402 moves downward as indicated by arrow 2404 to help pre-open the web. The optional member 2600 may be a spring member or spring biased member that forces the front layer of the web upward or downward when the engagement member 404 engages the web. In the example illustrated by FIGS. 26 and 27, the optional member 2600 comprises a spring arm or leaf spring that is compressed and extends to move the front layer of the web downward as indicated by arrow 2604 to help pre-open the web.

Figure 21:
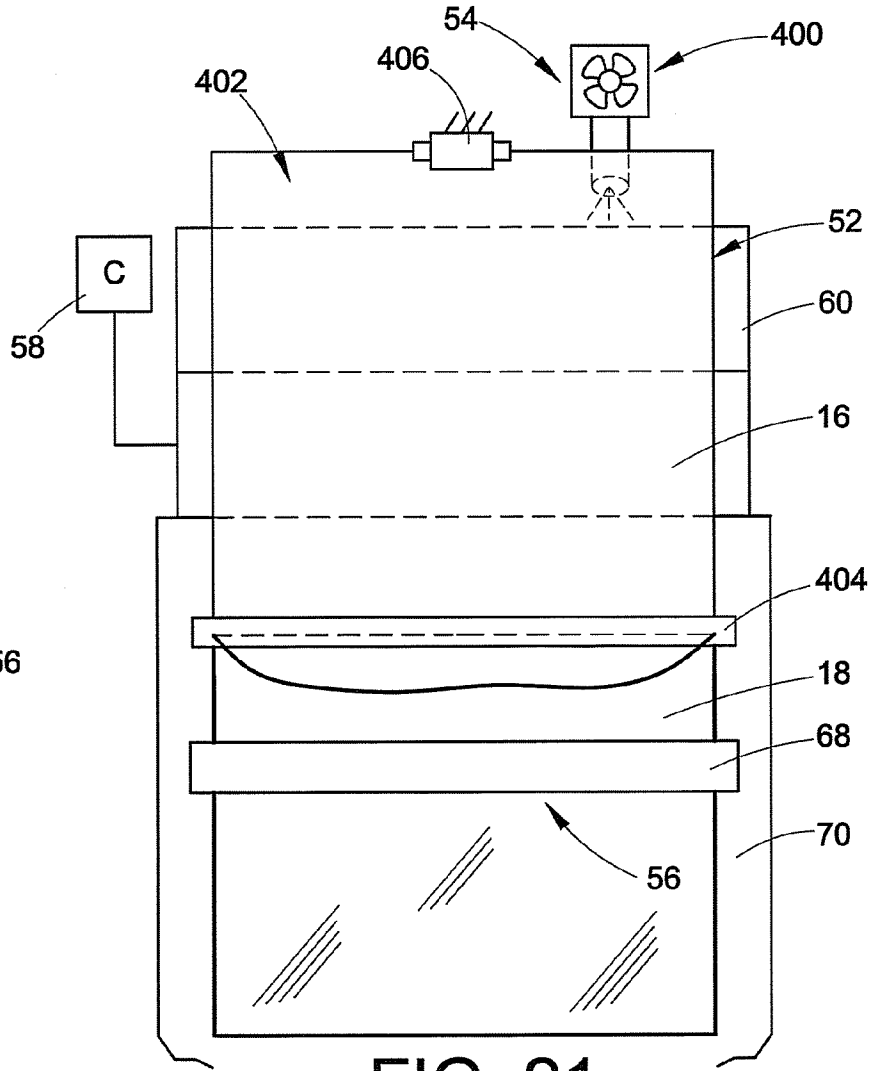
FIG. 21 is a view of the apparatus taken along lines 21-21 in FIG. 20.
Figure 20:
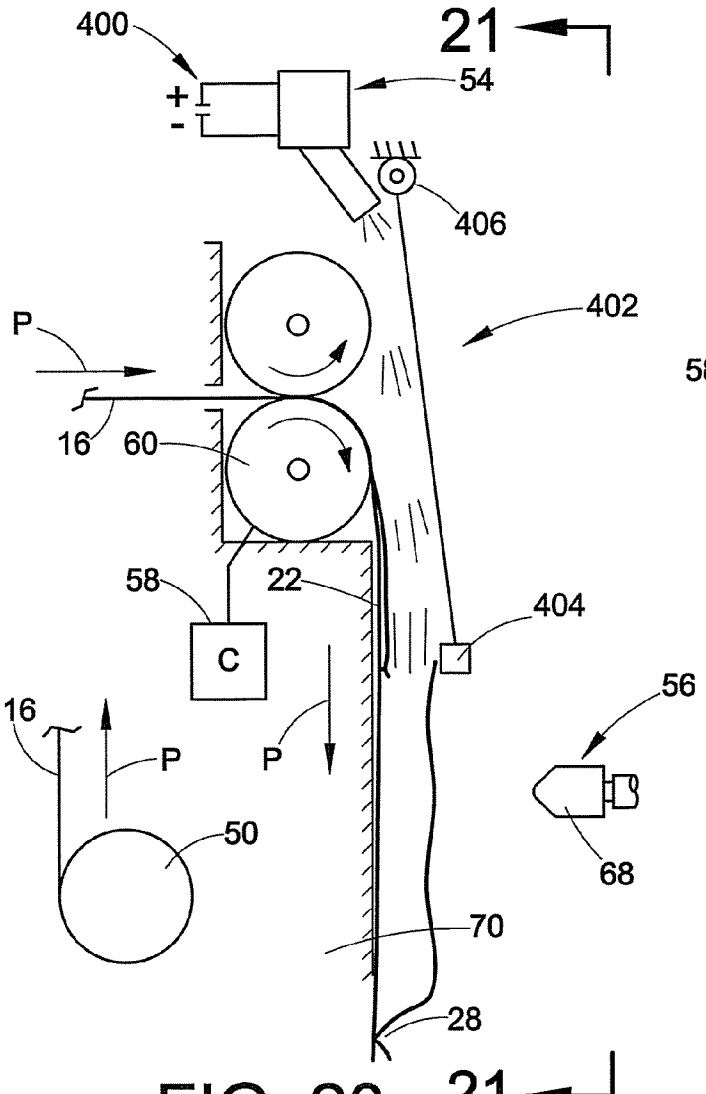
FIG. 20 is a schematic illustration of the apparatus with the bag being blown open by a source of air.

Referring to FIGS. 20 and 21, the controller causes the motor or actuator 406 of the engagement device 402 to move the engagement member 404 out of engagement with the web. Air from the blower 400 is forced between the pre-opened plies 20, 22 at the opening 30 of the bag. The air is forced between the plies through the opening 30 to inflate the bag 18 for depositing product 40 therein.

Figure 23:
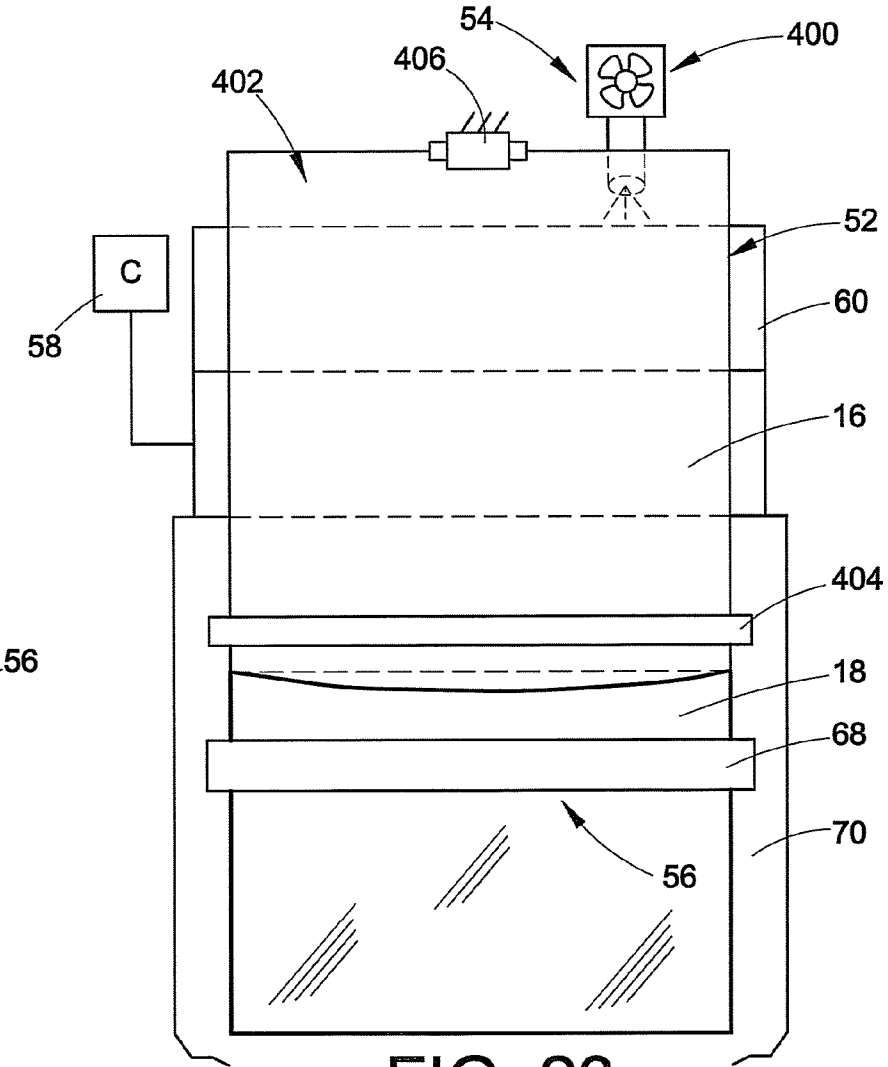
FIG. 23 is a view of the apparatus taken along lines 23-23 in FIG. 22.
Figure 22:
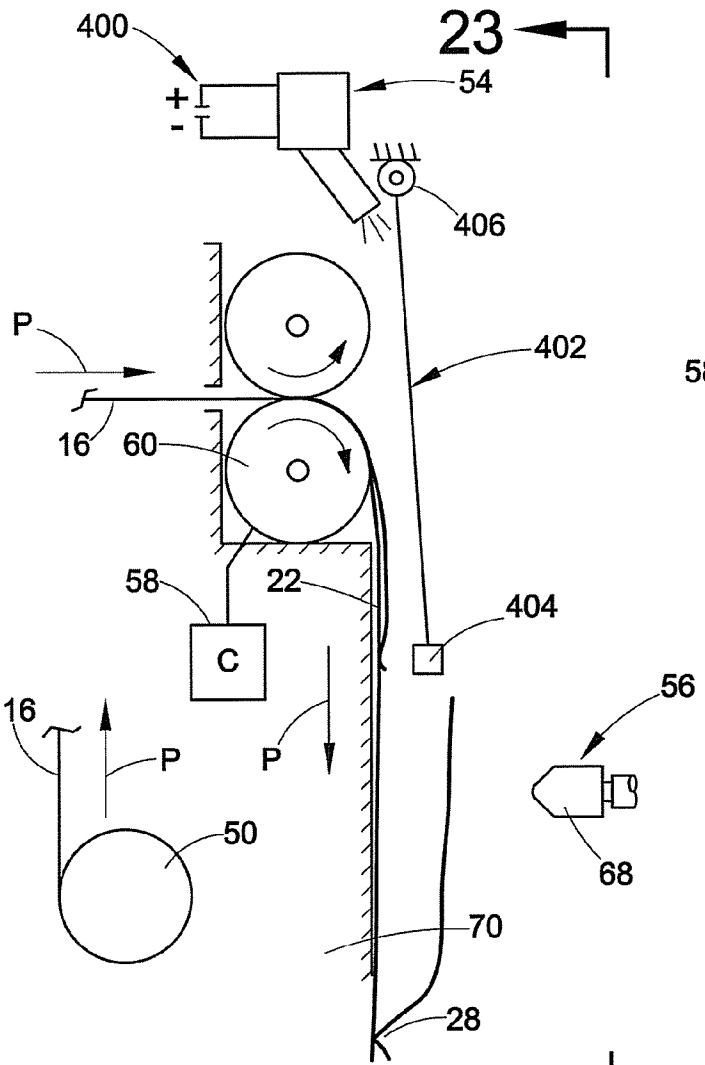
FIG. 22 is a schematic illustration of the apparatus with the bag in the open condition for loading with a product.

Referring to FIGS. 22 and 23, the controller 58 indexes the web 16, with the open bag 18 to the load position. The bag is held open by the air and the cycle begins again. The controller may repeat the method as required to produce as many packages are needed from the web.

It should be understood that the embodiments discussed above are representative of aspects of the invention and are provided as examples and not an exhaustive description of implementations of an aspect of the invention.

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, software, hardware, control logic and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

The invention claimed is:

1. A method of forming packages from a web of preformed bags comprising:

holding a first bag open with air;

loading a product into the first bag that is held open with air;

sealing an opening of the first bag;

indexing a next bag such that an opening of the next bag is proximate to an engagement member;

engaging the web with the engagement member by contacting the web with the engagement member and reverse indexing the web while the engagement member is in contact with the web to pre-open said next bag;

disengaging the web with the engagement member by moving the engagement member out of contact with the web; and opening said next bag with air for loading.

2. The method of claim 1 further comprising separating the first bag from said next bag.

3. The method of claim 1 wherein said next bag is indexed such that the opening of the next bag is below the engagement member and the engagement member engages the web above the opening of the next bag.

4. The method of claim 1 wherein said next bag is indexed such that the opening of the next bag is above the engagement member and the engagement member engages the web below the opening of the next bag.

5. The method of claim 1 wherein said next bag is indexed such that the opening of the next bag is substantially aligned with the engagement member and the engagement member engages the web at the opening of the next bag.

6. The method of claim 1 further comprising engaging the web with the engagement member after the product is loaded into the first bag to reduce a volume of air in the bag.

7. The method of claim 6 wherein the web is engaged with the engagement member after the product is loaded into the first bag and a signal is provided that causes the first bag to be sealed.

8. A method of forming packages from a web of preformed bags comprising:

holding a first bag open with air;

loading a product into the first bag that is held open with air;

sealing an opening of the first bag;

indexing a next bag such that an opening of the next bag is proximate to an engagement member;

engaging the web with the engagement member by contacting the web with the engagement member to pre-open said next bag;

disengaging the web with the engagement member by moving the engagement member out of contact with the web; and opening said next bag with air for loading.

9. The method of claim 8 further comprising separating the first bag from said next bag.

10. The method of claim 8 further comprising engaging the web with the engagement member after the product is loaded into the first bag to reduce a volume of air in the bag.

11. A method of forming packages from a web of preformed bags comprising:

holding a first bag open with air;

loading a product into the first bag that is held open with air;

engaging the web with an air restrictor to reduce a volume of air in the first bag;

sealing an opening of the first bag;

moving the air restrictor away from the web;

separating the first bag from a next bag;

indexing a next bag such that an opening of the next bag is proximate to the air restrictor;

engaging the web with the air restrictor by contacting the web with the air restrictor;

pulling on the web while the air restrictor is in contact with the web to pre-open said next bag;

disengaging the web with the air restrictor by moving the air restrictor out of the contact with the web; and opening said next bag with air for loading.

12. The method of claim 11 wherein said next bag is indexed such that the opening of the next bag is below the air restrictor and the air restrictor engages the web above the opening of the next bag.

13. The method of claim 11 wherein said next bag is indexed such that the opening of the next bag is above the air restrictor and the air restrictor engages the web below the opening of the next bag.

14. The method of claim 11 wherein said next bag is indexed such that the opening of the next bag is substantially aligned with the air restrictor and the air restrictor engages the web at the opening of the next bag.

* * * * *